US006663438B1

(12) United States Patent
Guilmette

(10) Patent No.: US 6,663,438 B1
(45) Date of Patent: Dec. 16, 2003

(54) MODULAR CABLE ASSEMBLIES

(75) Inventor: Michael A. Guilmette, Westport, MA (US)

(73) Assignee: WPFY, Inc., Wilmington, DE (US)

( * ) Notice: Subject to any disclaimer, the term of this patent is extended or adjusted under 35 U.S.C. 154(b) by 0 days.

(21) Appl. No.: 09/687,703

(22) Filed: Oct. 13, 2000

(51) Int. Cl.[7] ..... H01R 13/502
(52) U.S. Cl. ..... 439/687; 437/439
(58) Field of Search ..... 439/924.1, 502, 439/92, 93, 215, 108, 465, 269.2, 607, 687, 440, 284

(56) References Cited

U.S. PATENT DOCUMENTS 3,794,957 A 2/1974 Winkler
4,483,575 A * 11/1984 Kruger et al. ..... 439/102
4,500,796 A * 2/1985 Quin ..... 307/147
5,038,005 A * 8/1991 Hohorst et al. ..... 200/51.06
5,295,856 A * 3/1994 Endo et al. ..... 439/364
5,468,914 A * 11/1995 Falciglia et al. ..... 174/112
5,679,016 A * 10/1997 Marder et al. ..... 439/171
5,727,963 A 3/1998 LeMaster
6,033,256 A * 3/2000 Odorfer ..... 439/465
6,042,399 A * 3/2000 Jaakkola ..... 439/122
6,083,053 A * 7/2000 Anderson, Jr. et al. ..... 439/687

* cited by examiner

*Primary Examiner*—Tho D. Ta
*Assistant Examiner*—James R. Harvey
(74) *Attorney, Agent, or Firm*—Fish Richardson; Tu N. Nguyen

(57) ABSTRACT

A modular connector includes a housing assembly having a port configured for receiving an armored cable, a first connector insert disposed in the housing assembly, and a first contact and a second contact in the first connector insert. The first connector insert is configured to be attached to a second connector insert in a second modular connector in a direction of attachment. The first contact includes a contact end, and the second contact includes a contact end spaced from the contact end of the first contact in the direction of attachment.

31 Claims, 16 Drawing Sheets

MODULAR CABLE ASSEMBLIES

BACKGROUND OF THE INVENTION

The invention relates to armored cable and flexible cord.

Armored cable typically has a metal sheath (the armor) enclosing one or more individually insulated conductors, e.g., wires. The metal sheath may be formed of a helically interlocked continuous strip of metal, or a smooth or corrugated continuous metal tube.

Armored cable is used in constructing commercial wiring systems to distribute electricity for lighting or convenience power. Typically, a number of segments of armored cable are used in a wiring system, for example, that provides power to a series of lighting fixtures in a ceiling. The segments of armored cable in the wiring system must be connected to each other and also to conductors from the lighting fixtures. These connections conventionally are made on-site by linking the ends of the cable, and also the conductors from the fixtures, using cable connectors, wire nuts, and miscellaneous hardware.

Modular armored cable assemblies are known. Such assemblies include a precut segment of armored cable having a modular connector attached to each end. A modular connector generally includes a housing assembly with a port for receiving the end of a segment of armored cable and a metal or plastic housing. A modular connector also typically includes one or more plastic connector inserts containing electrical contacts through which an electrical connection is made between conductors from the armored cable and conductors in a modular connector on another segment of armored cable. Generally, the modular connector at one end of a cable assembly may include a connector insert with female channels or male leads that match the female channels and may also include a modular connector at the other end of the cable assembly of similar construction.

Modular cable assemblies can be pre-assembled in the desired lengths, with the appropriate modular connectors, and then transported to the installation site of the wiring system. The armored cable assemblies then can be attached sequentially and connected electrically to the electrical panels and their loads in order to provide the wiring system.

SUMMARY OF THE INVENTION

The invention relates generally to electrical connectors, e.g. modular connectors for use with armored cable and flexible cord. The modular connectors can also be used, e.g., in a modular cable assembly.

In particular, the modular connectors are configured for contact sequencing such that electrical contacts in one portion of a connector connect with electrical contacts in a matching portion of the connector in a predetermined, specified sequence. That is, by staggering the positions of the contacts within the connector portions, the contacts connect together at different times (i.e., not simultaneously) when the connector portions are mated together.

In some applications, e.g., alternating current applications that use three-phase power with inductive loads, connectors connect all three phases of the system using one connector pair. In cases where there is an inductive electrical load at high voltages, each one of these three phases can produce a high-power electrical arc. Therefore, disconnecting all three phases at the same time can produce three high-power arcs simultaneously.

By sequencing the mating and unmating time for the contacts in the connectors, e.g., by disconnecting two of the three phases before the third phase, the amount of arcing in the first two phases can be minimized or eliminated and the amount of power dissipation from the remaining electrical arc can be minimized. Thus, the risk of electrical arcing is minimized, which reduces the risk of danger to personnel, the risk of fire, and/or the possible degradation to the connector. Moreover, because the amount of electrical arcing that the connector material preferably needs to withstand is reduced, cost-effective materials can be used to produce the connectors. The contact sequencing described herein can also be applied to other connectors used in electrical systems having multiple, e.g., greater than three, phases, or in connectors used in three-phase systems and carrying multiples of the three phases, particularly where electrical arcing can result.

Other features and advantages of the invention will be apparent from the description of the preferred embodiments thereof, and from the claims.

DESCRIPTION OF THE PREFERRED EMBODIMENTS

Figure 1:
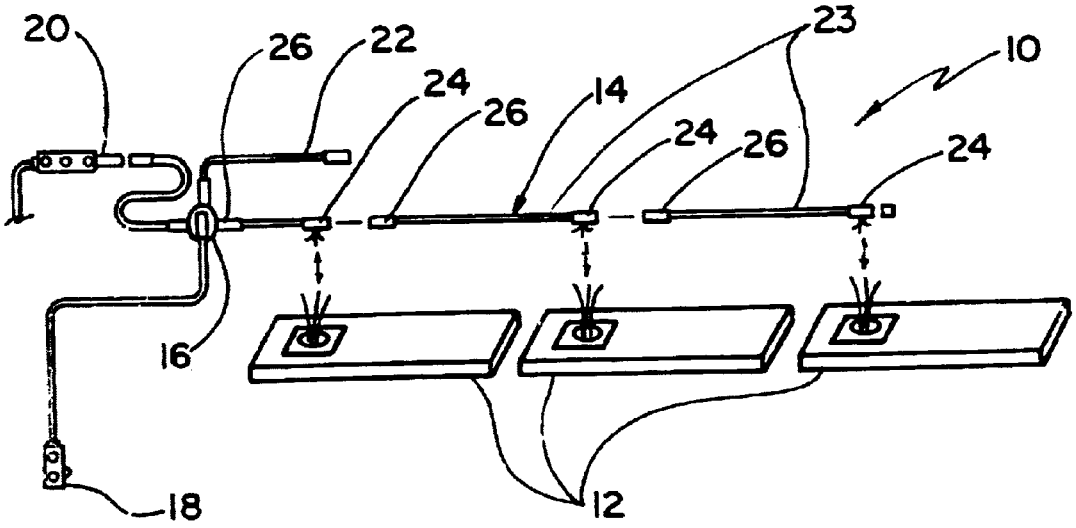
FIG. 1 is a plan view of a modular wiring system.
Figure 2:
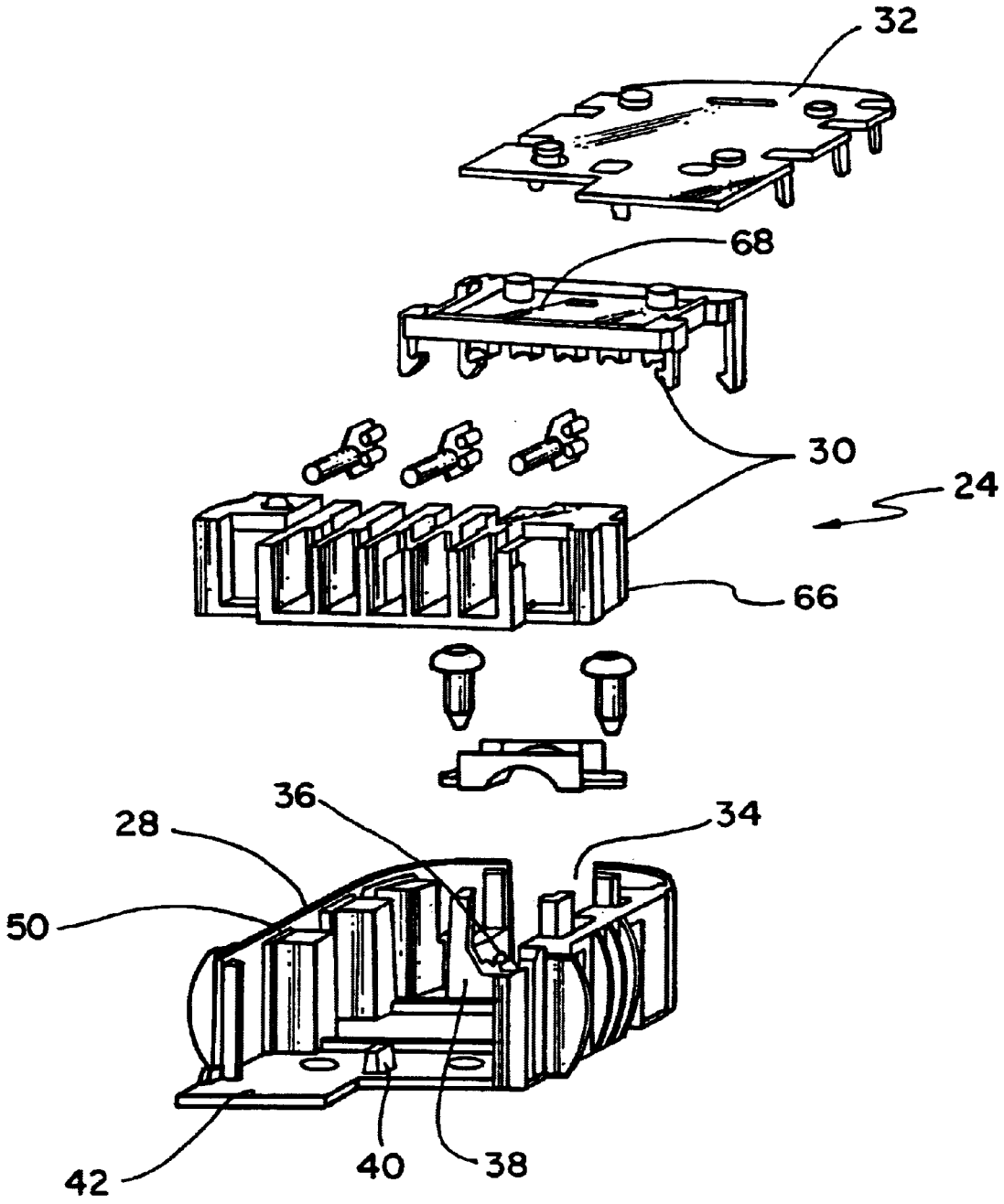
FIG. 2 is an exploded view of a modular connector in the wiring system in FIG. 1.
Figure 3:
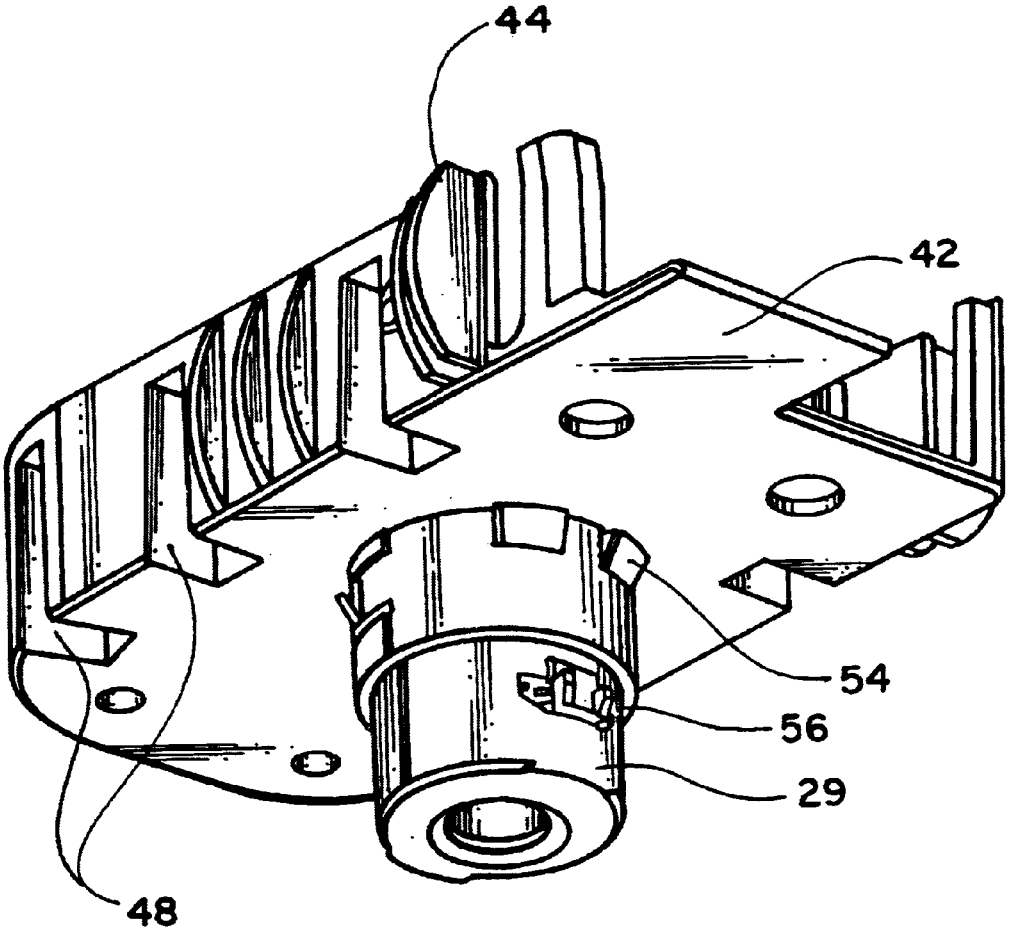
FIG. 3 is a perspective view of the housing in the modular connector in FIG. 2, with a fixture adapter.

Referring to FIG. 1, a modular wiring system 10 for providing power to lighting fixtures 12 includes armored lighting cable assemblies or fixture cable assemblies 14, switch module 16 connected to switch 18, circuit starter 20, and armored extender cable assemblies 22. Each lighting cable assembly 14 includes an armored cable 23 having a female modular connector 24 on one end and a male modular connector 26 on the other end. Conductors passing through modular connector 24 and a fixture adapter collar (discussed below) provide power to the lighting fixtures.

Referring to FIGS. 2–9, female modular connector 24 includes housing 28, connector insert 30, and cover 32.

Housing 28 includes a port 34 for receiving the armored cable, V-shaped elements 36 for stabilizing and supporting the cable (see also FIG. 14), and U-shaped element 38 for preventing the armored cable from penetrating into the housing beyond the U-shaped element. V-shaped elements 36 rest in the grooves in the armor of the cable; each V-shaped element provides two distinct points of contact for the cable. Housing 28 further includes a metal tab 40 extending vertically from the base of the housing, modular protective element 42, thumb grip 44 with integrated hanger 46, channels 48 including slots 50, and, optionally, phase selector switch 51. Modular connector 24 optionally may include either a fixture adapter collar 29 (see FIGS. 3, 7, and 8) or a phase selector switch 51 (see FIGS. 6A and 6B). The phase selector switch allows an installer to select the appropriate electrical circuit and phase during installation of the wiring system.

Fixture adapter collar 29 is attached to housing 28 through a port in the base of the housing. Fixture adapter collar 29 includes snap elements 54 and snap elements 56. The conductors (not shown) that provide power to a lighting fixture 12 pass through the fixture adapter collar.

Figure 8:
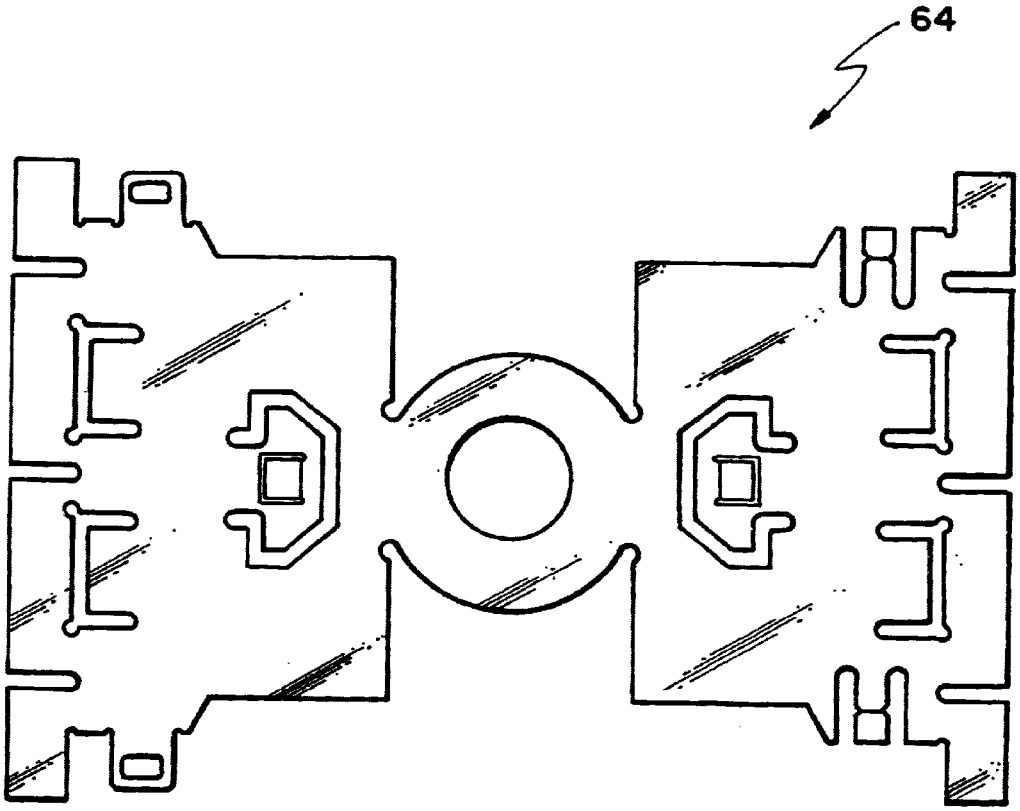
FIG. 8 is a top view of the stamped metal piece used to form the fixture collar in FIG. 7.

Fixture adapter collar can be manufactured by stamping spring steel to provide stamped piece 64 (see FIG. 8). The stamped piece then is converted through multiple forming operations into fixture adapter collar.

In use, the end of fixture adapter collar 29 including snap elements 56 and 54 is pushed through the port in the base of housing 28. Snap elements 56 snap open after they pass through the port to secure the fixture adapter collar 29 in the housing. The end of fixture adapter collar 29 having snap elements 54 can be pushed into an opening in the lighting fixture to secure modular connector 24 to the lighting fixture. Although secured to the lighting fixture, the fixture adapter collar can still be detached if desired from the fixture without undue effort.

Figure 6A:
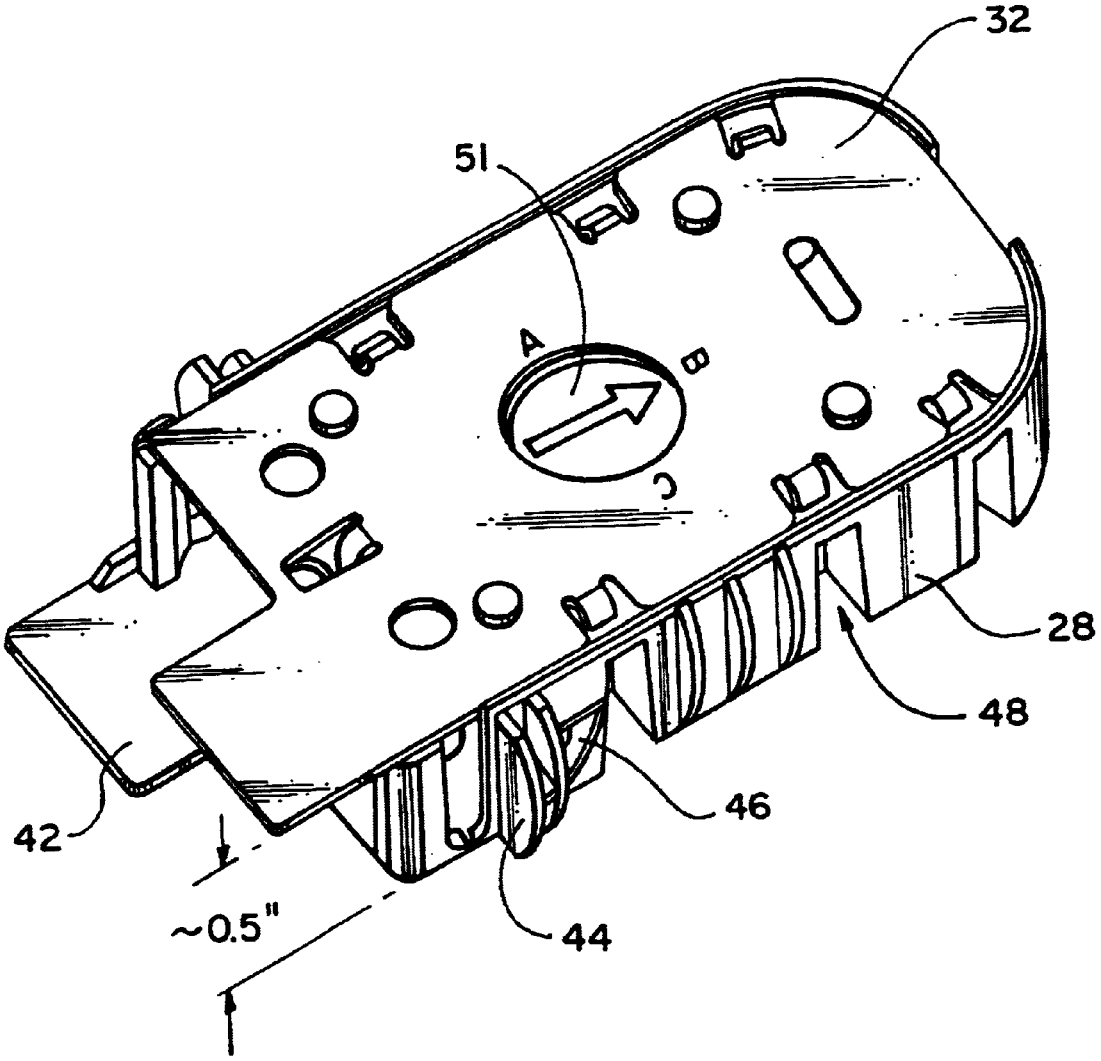
FIG. 6A is a perspective view of a modular connector, with a phase selector.
Figure 6B:
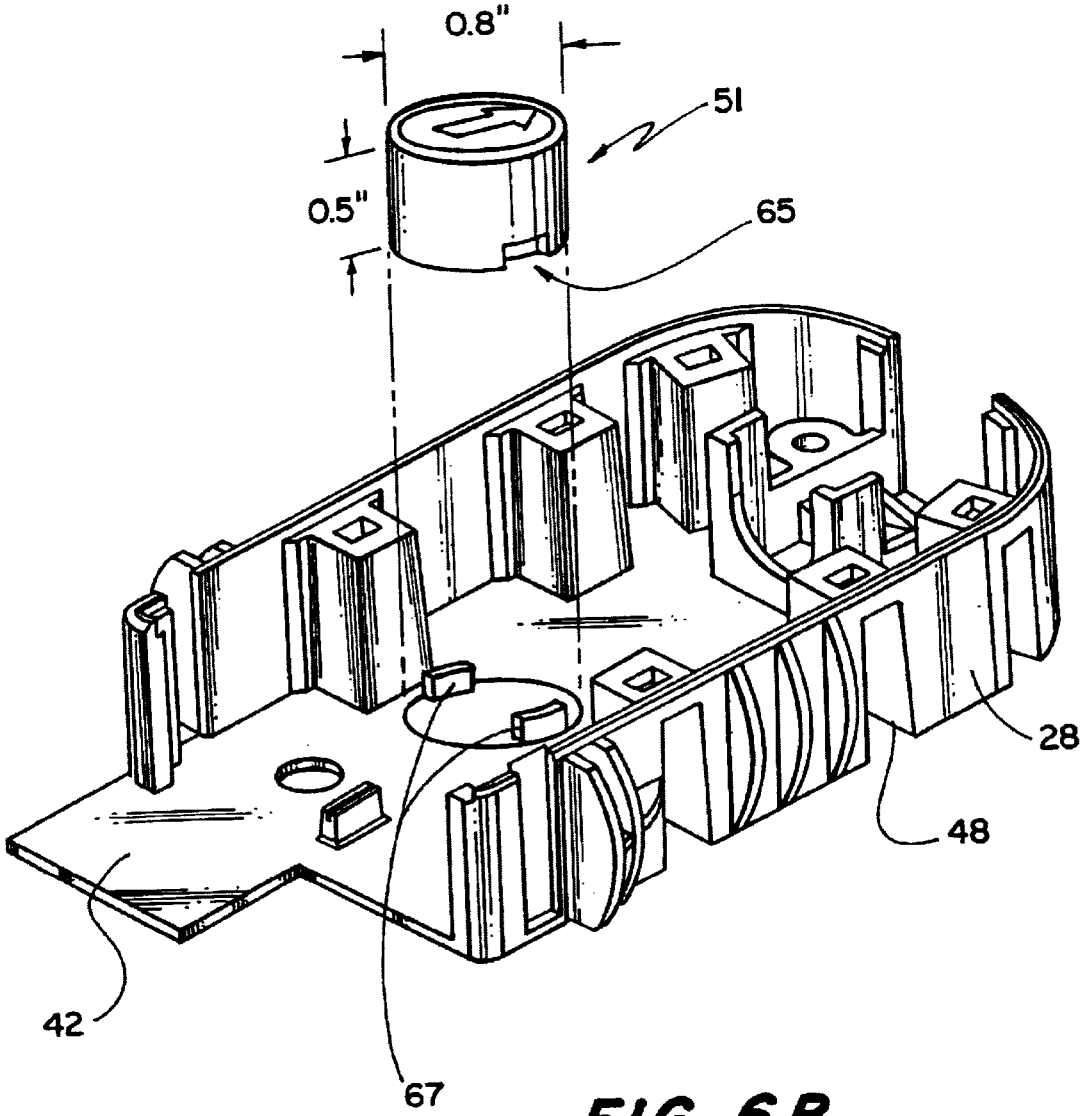
FIG. 6B is a perspective view of the modular connector in FIG. 6A, with the cover removed.
Figure 7:
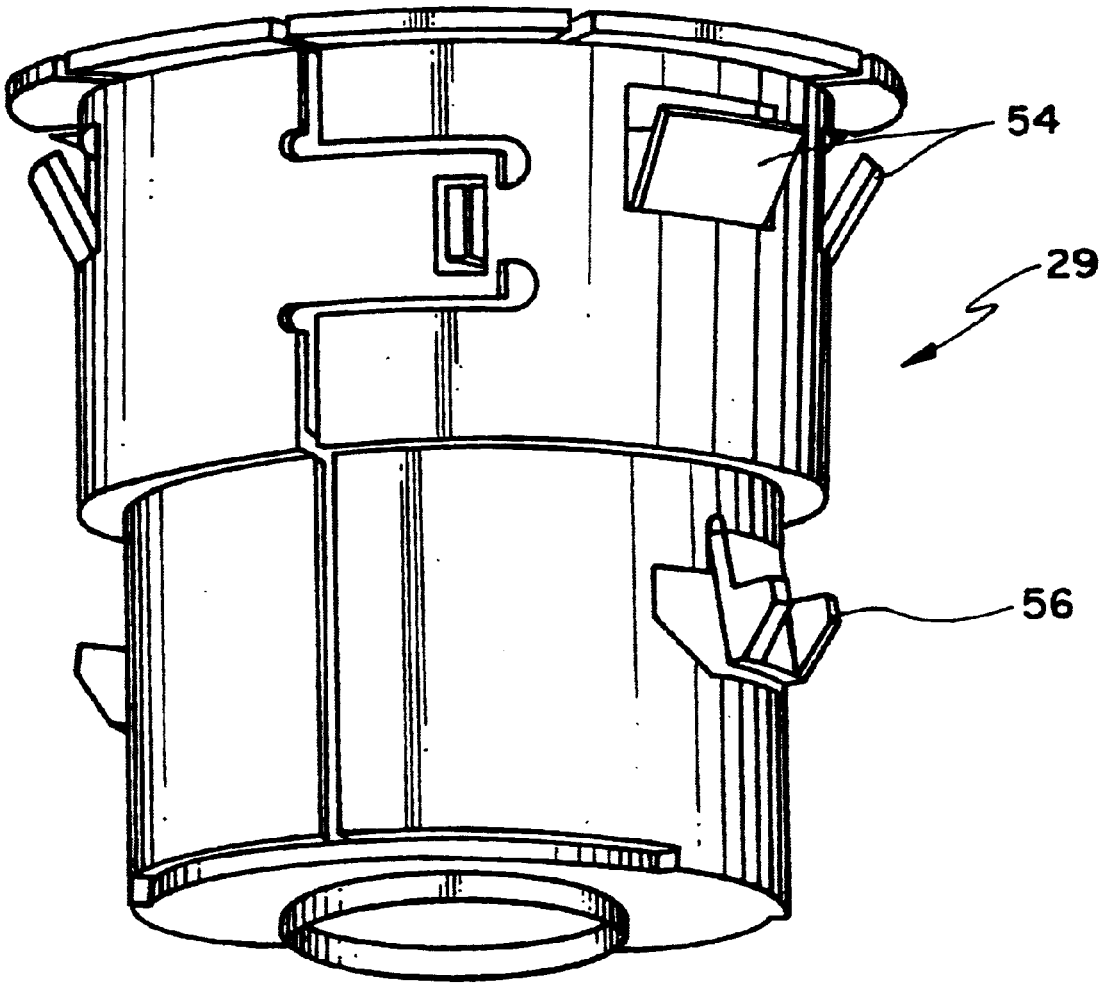
FIG. 7 is a side view of a fixture adapter collar.

Phase selector switch 51 includes notches 65 that receive elements 67 when the modular connector is assembled (see FIG. 6B). Notches 65 and elements 67 prevent the switch housing from rotating and also provide a convenient keying mechanism.

Connector insert 30 includes a lower portion 66 and an upper portion 68. Lower portion 66 includes channels 70 for positioning wires leading from the connector insert to the armored cable and fixture adapter collar 29; female channels 72 for receiving male leads 73 in male connector insert 74 from modular connector 26; and insert interlock element 76. Pin contacts (not shown) are included in male connector insert 74; socket contacts (not shown) are included in female connector insert 30. Conductors are welded to the back of the contacts and exit through openings in their back end. Lower portion 66 also includes slot 84 for receiving metal tab 40 from housing 28 during assembly. When modular connector 24 is assembled with contacts and conductors inside, the ground contact engages metal tab 40 to ground the connector.

Figure 10:
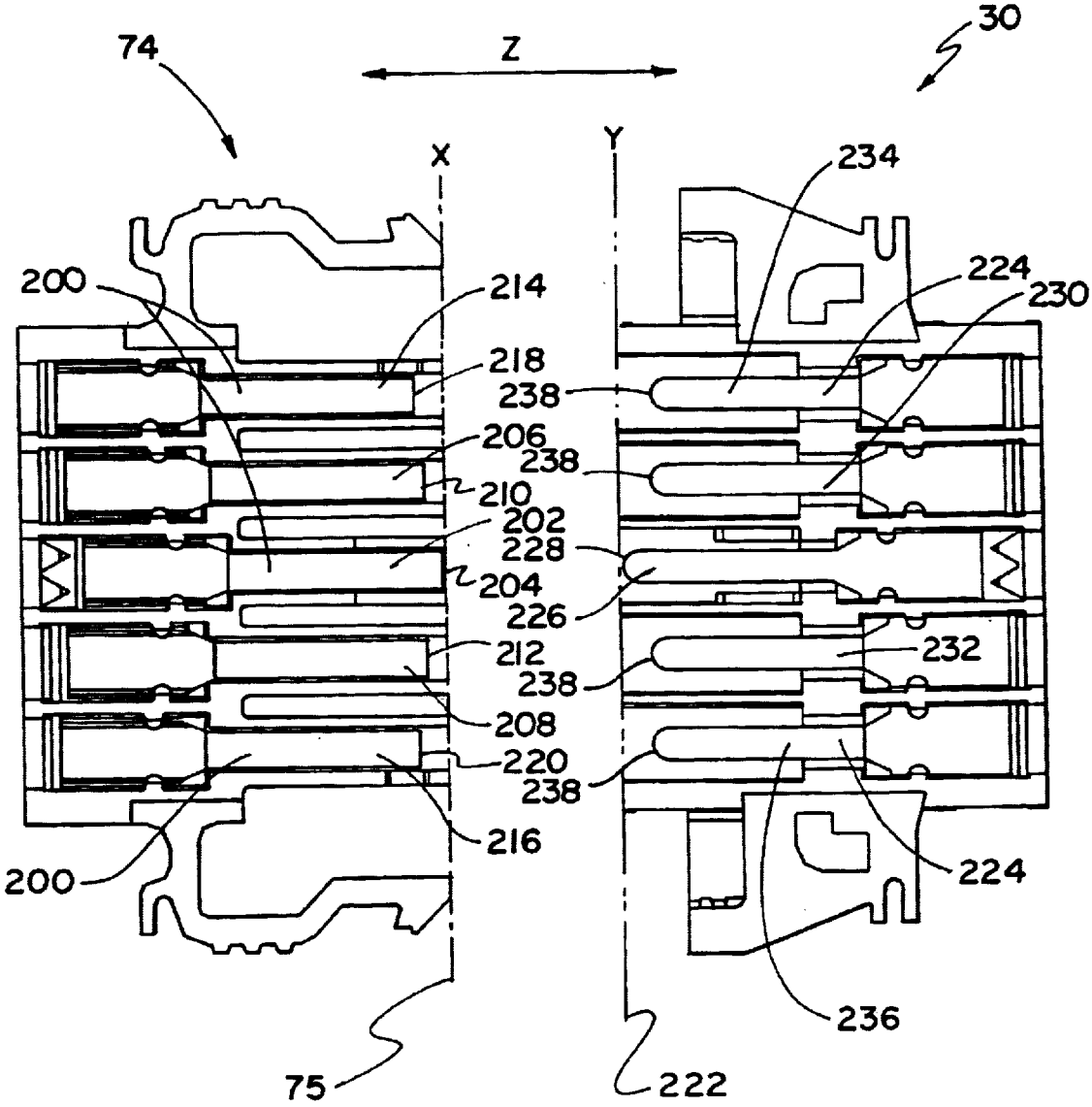
FIG. 10 is a partial, cross-sectional view of an embodiment of male and female connector inserts.

In certain embodiments, the connector contacts are placed at various depths within the connectors to provide contact sequencing, for example, by using electrical contacts of different lengths to effectively stagger their depths with a connector insert. Referring to FIG. 10, male connector insert 74 defines a contact edge 75 (Plane X) and includes five socket contacts 200 having contact ends variously spaced from the contact edge. Central contact 202 has a contact end 204 that is located at contact edge 75. On both sides of central contact 202 are two contacts 206 and 208 having contact ends 210 and 212, respectively, spaced from contact edge 75. In other words, contact ends 210 and 212 are spaced from contact end 204 of central contact 202. In this particular embodiment, contact ends 210 and 212 are spaced equally from edge 75.

On both outer sides of contacts 206 and 208 are two more contacts 214 and 216 having contact ends 218 and 220, respectively, spaced from contact edge 75. As shown in FIG. 10, contact ends 218 and 220 are spaced equally from edge 75, and the spacing between edge 75 and contact ends 218 and 220 is greater than the spacing between edge 75 and contact ends 210 and 212. In this embodiment, the connection sequence is not affected by rotational misalignment between the connector inserts because the configurations of the contacts are symmetrical about a central axis bisecting central contact 204.

Female connector insert 30 defines a contact edge 222 (Plane Y) and includes five pin contacts 224 having contact ends variously spaced from the contact edge. Central contact 226 has a contact end 228 that is located at contact edge 222. On each side of central contact 226 are two contacts 230, 232, 234 and 236 having contact ends 238 spaced from contact edge 222. Contact ends 238 are spaced equally from edge 222.

Male connector insert 74 and female connector insert 30 are configured to mate together along a direction of attachment (Arrow Z). As the connector inserts are brought together, the contacts connect together in a specified sequence, depending on the spacings between the contact ends and the contact edges. Here, as the connectors 74 and 30 are inserted together, first central contact 204 connects with central contact 226. Contacts 206 and 208 then connect with contacts 230 and 232, respectively. Then, contacts 214 and 216 connect with contacts 234 and 236, respectively. As the connectors are unmated, the contacts disconnect in the reverse order of their connection sequence.

Figure 11:
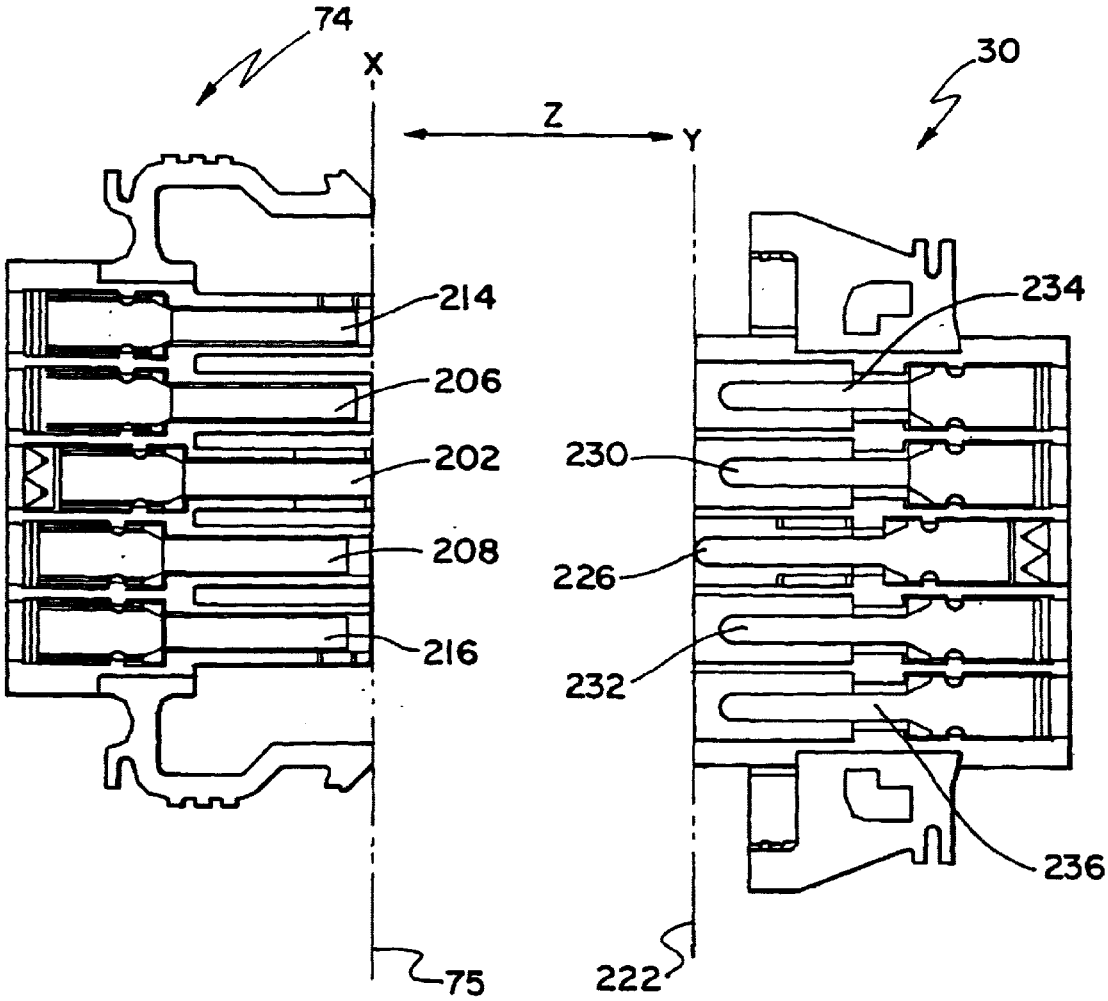
FIG. 11 is a partial, cross-sectional view of an embodiment of male and female connector inserts.

Other configurations for the contacts, both in male connector insert 74 and in female connector insert 30, are possible to provide connection of the contacts in a specified, predetermined sequence. For example, referring to FIG. 11, in another embodiment, contacts 206 and 214, which are on one side of central contact 202, have contact ends that are equally spaced from edge 75. Contacts 208 and 216, on the other side of central contact 202, have contact ends that are equally spaced from edge 75, but this spacing is different (here, greater) than the spacing between edge 75 and contact ends of contacts 206 and 214. Thus, when connector insert 74 is brought together with connector insert 30, contact 202 connects with contact 226 first. Then contacts 206 and 214 connect with contacts 230 and 234, respectively; and then contacts 208 and 216 connect with contacts 232 and 236, respectively.

Numerous other configurations for the contacts are possible. The spacings between the contact ends and a contact edge can be varied in other combinations that can provide safe and usable sequential contact connection. For example, referring to FIG. 10, the spacing between contacts 206 and 208 and edge 75 can be greater than the spacing between contacts 214 and 216 from edge 75. The uniformly spaced contacts can be in the male connector insert, and the variously spaced contacts can be in the female connector insert. Connector inserts 74 and 30 can have, for example, two, three, four, six, and greater than six contacts of various spacings from a contact edge, e.g., in other multi-phase power systems.

Referring back to FIG. 4, the lower portion of male connector insert 74 includes interlock element 86. When modular connectors 24 and 26 are connected, interlock element 76 slides under the surface of interlock element 86. As a result, inserts 30 and 74 cannot readily rock in the plane corresponding to the bottom of the mated inserts.

Upper portion 68 includes slot 88.

Figure 4:
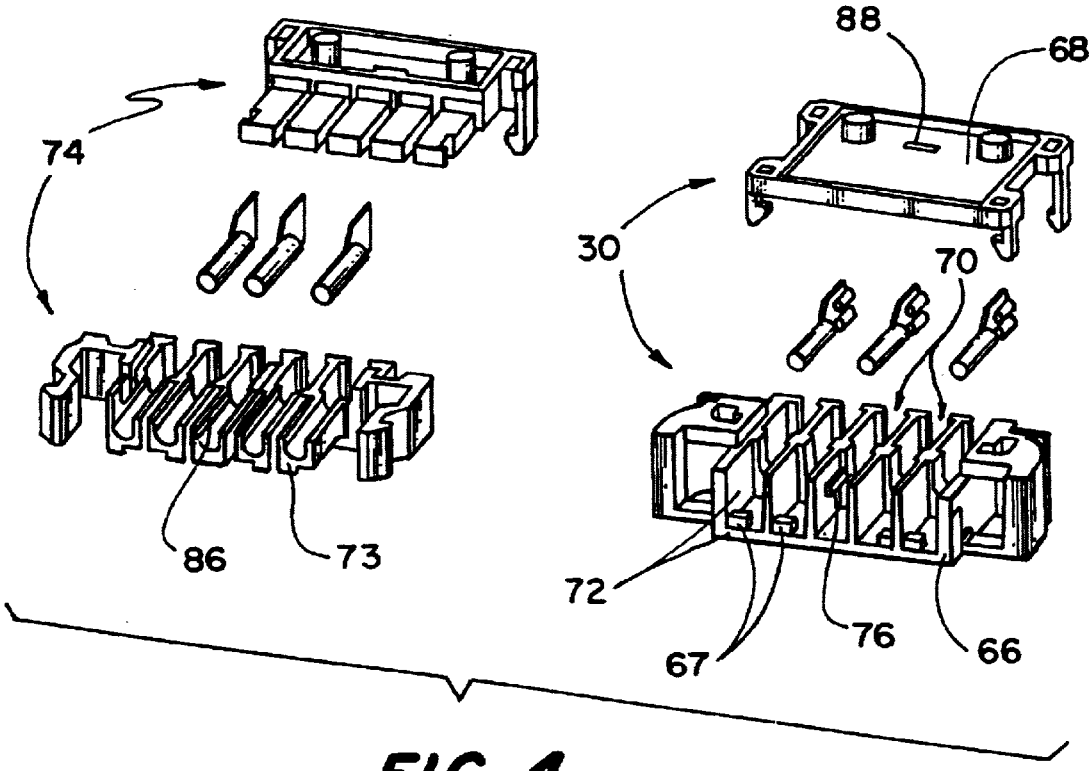
FIG. 4 is an exploded view of the connector insert in the modular connector in FIG. 2, and a male connector insert counterpart.
Figure 5:
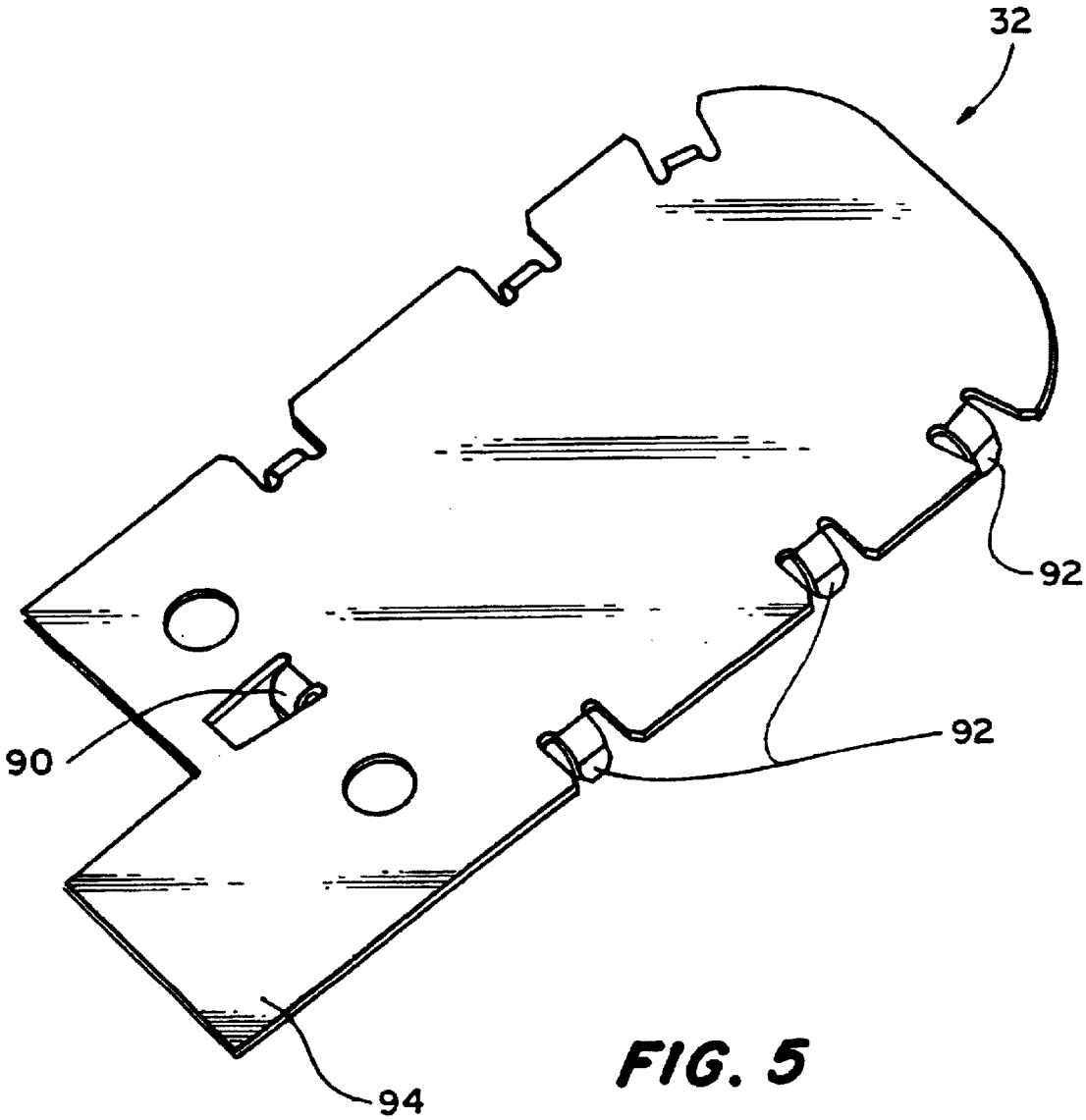
FIG. 5 is a perspective view of the cover in the modular connector in FIG. 2.

Connector inserts 30 and 74 also include a keying mechanism that prevents, for example, a 120V lighting assembly from being connected to a 227V lighting assembly. Referring to FIG. 4, lower portion 66 of connector insert 30 includes five adjacent female channels, and an expanded portion of the plastic material 67, or key, is in four of the adjacent channels to block the entry of male elements without the matching keys. Analogously, lower portion 86 includes five adjacent male elements. The male elements have plastic housings, and the plastic housings of the four male elements have portions of their plastic housing removed to match the key in the female channels.

Figure 12A:
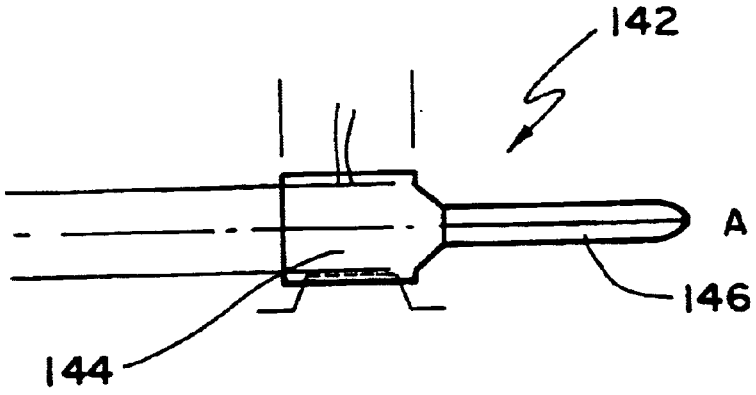
FIG. 12A is a top view of a conductor terminal and FIG. 12B is a side view of the terminal.
Figure 12B:
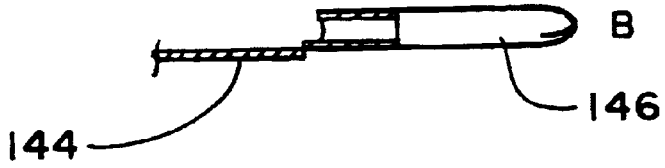

A terminal assembly 142 is positioned in connector insert 30 as shown in FIG. 12. Terminal assembly 142 includes a copper terminal 144 at the end of conductor 146. A portion of terminal 144 is flat. During assembly, the end of a conductor from the armored cable can rest on terminal 144 and then be easily ultrasonically welded to it before insertion into the connector insert. During assembly, the insert top is snapped onto the bottom and is incorporated into the housing.

Cover 32 includes downwardly extending metal tab 90 and downwardly extending metal tabs 92. When modular connector 24 is assembled, metal tab 90 is received by slot 88 and engages the grounding contact to provide a second path with which to ground the connector. Also during assembly, metal tabs 92 are received by corresponding slots 50. The metal tabs 92 then can be formed or crimped in channels 48 from the side of housing 28 to fasten metal cover 32 to housing 28. Modular connector 24 thus can be assembled without the use of separate fastening elements.

Figure 9:
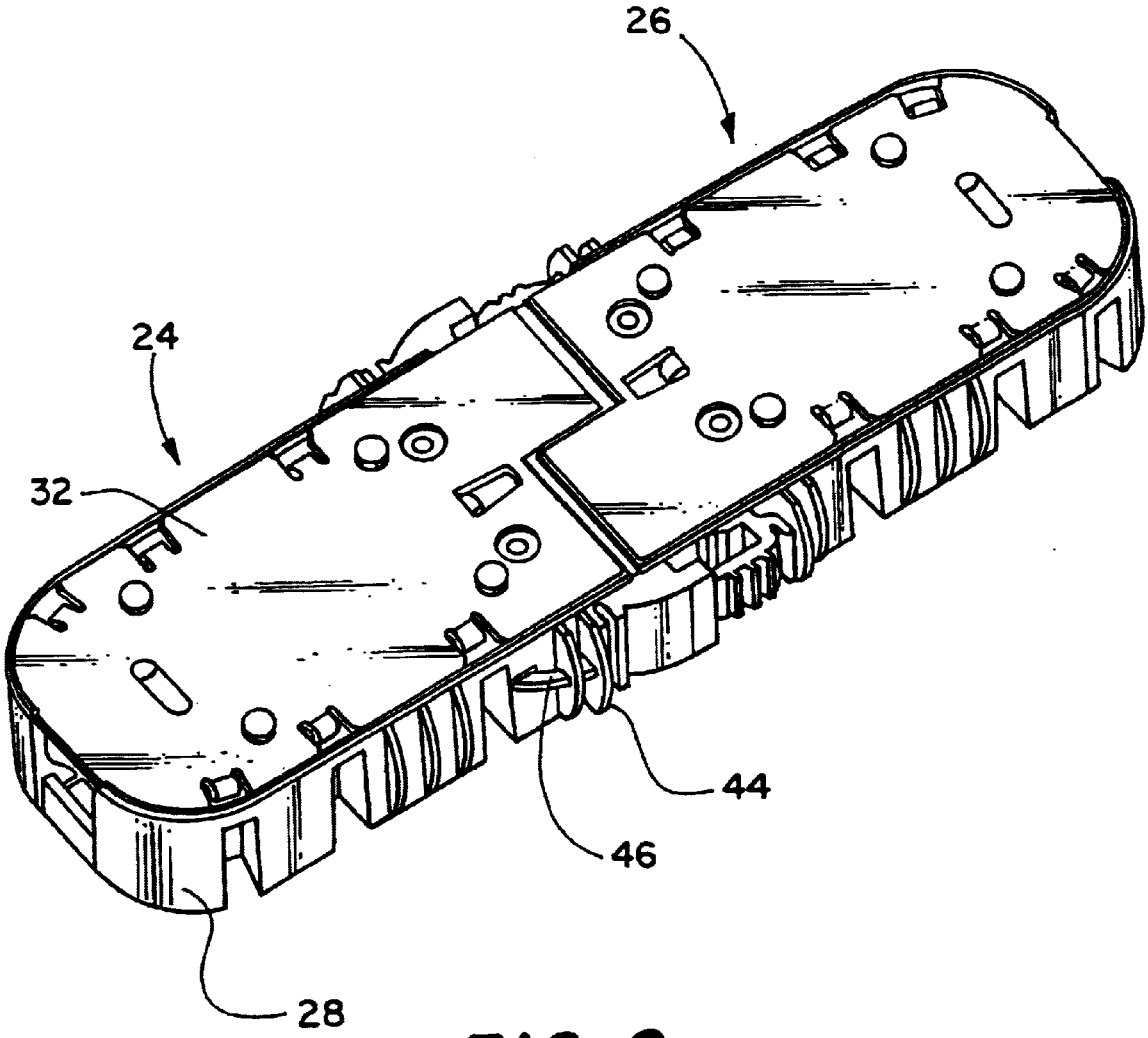
FIG. 9 is a perspective view of the modular connector in FIG. 2 attached to a corresponding modular connector.

Metal cover 32 further includes protective element 94, on the opposite side from protective element 42 in housing 28. Referring to FIG. 9, male modular connector 26 includes a protective element 96 in metal cover 98. Modular connector 26 is attached to modular connector 24 by inserting male leads (not shown) in a connector insert (not shown) in connector 26 into female channels 72 in housing 28. During this procedure, thumb grip 44 and a corresponding thumb grip on modular connector 26 inhibit thumbs from sliding along the side of the connectors 24 and 26. Protective element 96 in metal cover 98 is sized and positioned to fit adjacent to protective element 94 in cover 32 when modular connectors 24 and 26 are attached. Similarly, a protective element (not shown) in the base of housing 100 of connector 26 is sized and positioned to fit adjacent to protective element 42 in the base of housing 28 when modular connector 24 and 26 attached.

Housing 28 is made from a metal such as a zinc or aluminum alloy. Cover 32 is made from a metal such as steel or aluminum. Connector insert 30 is made from a thermoplastic such as polycarbonate.

There are numerous types of modular connectors, and a particular modular connector may include one or more of the various features discussed above. For example, modular connector 26 does not provide power to a lighting fixture, and thus would not include a fixture adapter like fixture adapter collar 29. However, in addition to the features of modular connector 26 discussed previously, modular connector 26 also includes V-shaped elements for stabilizing and supporting armored cable; a U-shaped element for preventing the armor on the cable from penetrating beyond a certain point in the housing; a metal tab in the base of its housing and another metal tab in the metal cover that can be received in corresponding slots in the connector insert to ground the modular connector; a housing including vertical elements (with slots) like element 48 for receiving metal tabs in the cover to fasten the cover to the housing; and terminal assemblies like terminal assembly 142.

Figure 13:
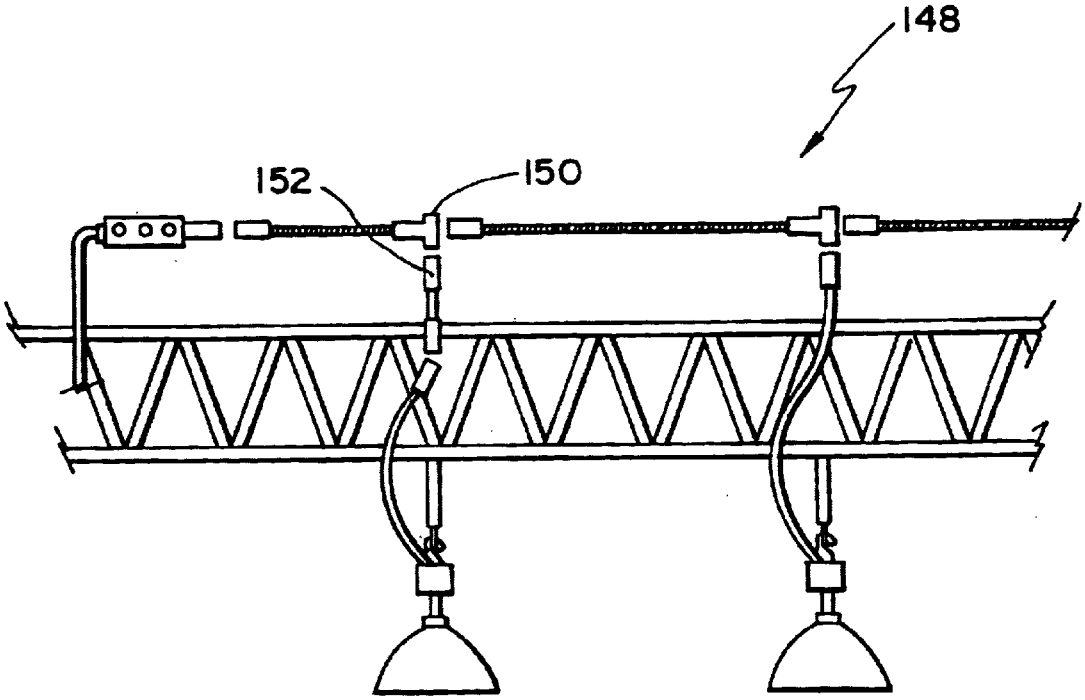
FIG. 13 is a plan view of a second wiring system.
Figure 14:
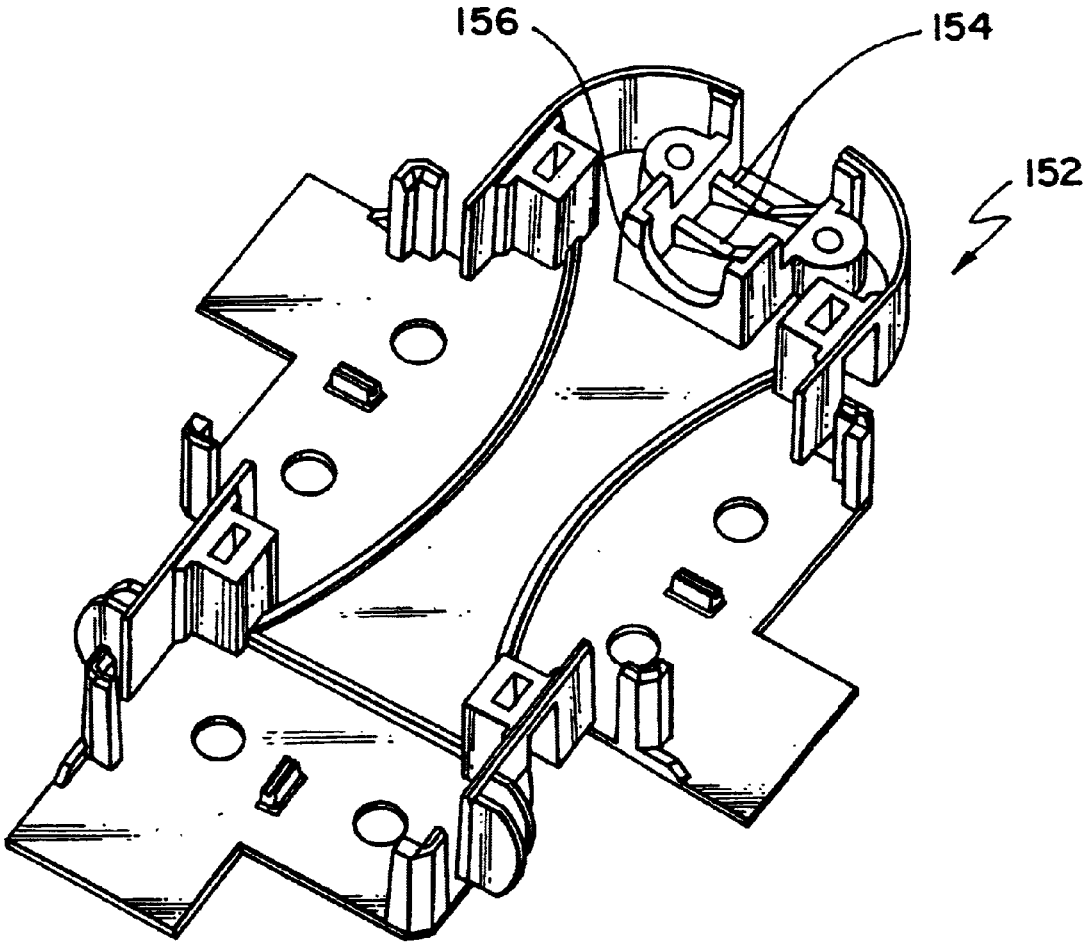
FIG. 14 is a perspective view of a housing of a modular connector used in the wiring system in FIG. 13.
Figure 15:
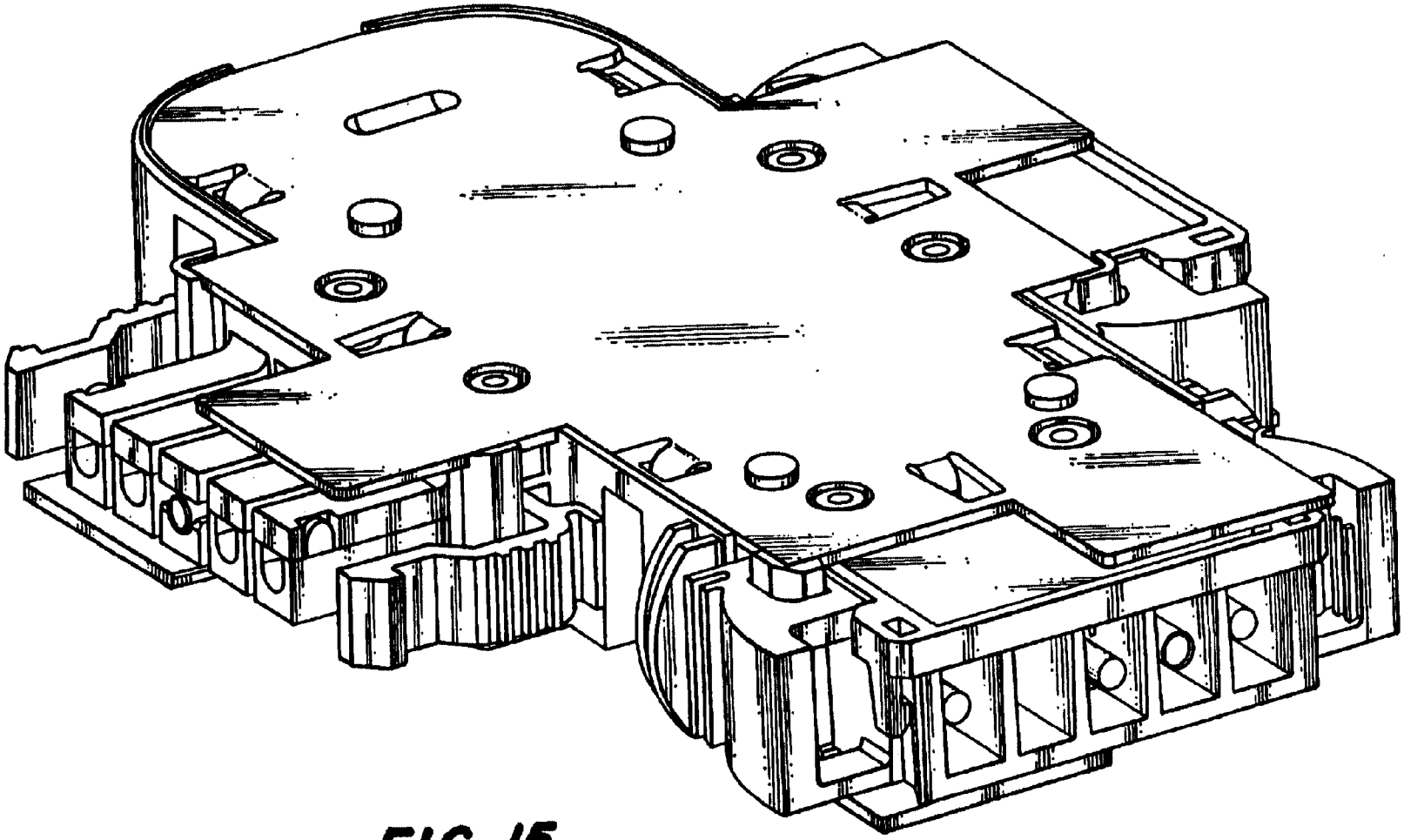
FIG. 15 is a perspective view of the modular connector including the housing in FIG. 14.

Referring to FIGS. 13–15, an alternative modular lighting system 148 includes a T-type modular connector 150 including housing 152 and metal cover 153. T-type modular connector 150 includes many of the features discussed above; see, for example, V-shaped element 154 corresponding to V-shaped element 36 and U-shaped element 156 corresponding to U-shaped element 38. But connector 150 does not include a fixture adapter collar. Instead, power is provided to a lighting fixture through a female connector insert (not shown) that receives the male leads in a connector insert of another modular connector 152 that ultimately connects to an armored cable or flexible cord that provides power to the lighting fixture.

Referring to FIG. 1, modular wiring system 10 includes a plurality of lighting cable assemblies 14 and extender cable assemblies 22. The lighting cable assemblies and extender cable assemblies used in modular wiring system 10 can be provided as a set. During installation of the modular wiring system, lighting cable assemblies and extender cable assemblies can be connected by attaching mating modular connectors on the ends of the assemblies.

The armored cable used in the wiring system can be precoded with visual indicia to indicate that particular cable assemblies should be used together. The visual indicia may be, for example, a color pattern precoded on the surface of each cable, as described, for example, in U.S. Pat. No. 5,468,914, which is incorporated herein by reference. Other visual indicia may be, for example, the color of the plastic connector insert. During installation of the wiring system, an installer can easily identify the cable assemblies designed for use with the wiring system because the relevant assemblies will be precoded with the same color pattern. Similarly, a person inspecting an installed modular wiring system, or otherwise tracking the cable assemblies used in the system, can identify the cable assemblies in the wiring system through the precoded color patterns on the cable and/or of the connector insert, and as a result, distinguish the cable assemblies for different wiring systems in the same area.

Other embodiments are within the claims.

What is claimed is:

1. A multi-phase interconnection system for a multi-phase electrical system, comprising:

a modular connector, comprising:

a housing assembly comprising a port configured for receiving an armored cable;

a first connector insert disposed in the housing assembly, the first connector insert configured to be attached to a second connector insert in a second modular connector in a direction of attachment;

a first phase contact in the first connector insert, the first phase contact comprising a contact end; and a second phase contact in the first connector insert, the second phase contact comprising a contact end spaced from the contact end of the first phase contact in the direction of attachment, the first phase contact being connected to a source of a first phase of power, and the second phase contact being connected to a source of a second phase of power.

2. The system of claim 1, wherein the connector further comprises a third phase contact in the first connector insert, the third phase contact comprising a contact end spaced from the contact ends of the first and second phase contacts in the direction of attachment, the third phase contact being connected to a source of a third phase of power.

3. The system of claim 1, wherein the connector further comprises a third phase contact in the first connector insert, the third phase contact comprising a contact end spaced from the contact end of the first phase contact in the direction of attachment equal to the spacing between the contact ends of the first and second phase contacts, the third phase contact being connected to a source of a third phase of power.

4. The system of claim 3, wherein the first phase contact is between the second and third phase contacts.

5. The system of claim 3, wherein the second phase contact is between the first and third phase contacts.

6. The system of claim 3, 4, or 5, wherein the connector further comprises a fourth phase contact in the first connector insert, the fourth phase contact comprising a contact end spaced from the contact ends of the first and second phase contacts in the direction of attachment, the fourth phase contact being connected to one of the sources of phase of power.

7. The system of claim 6, wherein the connector further comprises a fifth phase contact in the first connector insert, the fifth phase contact comprising a contact end spaced from the contact ends of the first and second phase contacts in the direction of attachment equal to the spacing between the fourth phase contact and the first phase contact, the fifth phase contact being connected to one of the sources of phase of power.

8. The system of claim 7, wherein the first, second and third phase contacts are between the fourth and fifth phase contacts.

9. The system of claim 8, wherein the first phase contact is between the second and third phase contacts.

10. The system of claim 8, wherein the spacing between the first and second phase contacts is less than the spacing between the first and fourth phase contacts.

11. The system of claim 7, wherein the first phase contact is between the second and fourth phase contacts.

12. The system of claim 11, wherein the first, second, and fourth phase contacts are between the third and fifth phase contacts.

13. The system of claim 12, wherein the fourth and fifth phase contacts are adjacent to each other.

14. The system of claim 1, wherein the housing assembly comprises attachment openings, and the modular connector further comprises a cover comprising integral attachment elements inserted through the attachment openings.

15. The system of claim 1, wherein the port is configured to receive an end of the armored cable having armor including an external groove, and the housing assembly further comprises a base including a V-shaped support element having arms resting in the external groove.

16. The system of claim 1, wherein the port is configured to receive an end of the armored cable having external armor and a conductor inside the external armor, and the housing assembly further comprises a base including a U-shaped element extending from the base configured to allow the conductor to extend beyond the U-shaped element while preventing the armor from extending beyond the U-shaped element.

17. The system of claim 1, wherein the housing assembly further comprises a base, a cover, and vertical sidewalls between the base and the cover on opposing sides of the housing assembly, each vertical sidewalls including a thumb grip with an integrated hanger.

18. The system of claim 1, wherein the housing assembly further comprises a protective element configured to form a protective closure when the modular connector is attached to the second modular connector having a corresponding protective element.

19. The system of claim 1, wherein the connector further comprises a fixture adapter collar inserted through a second port in the housing assembly, the fixture adapter collar including an integral housing attachment element that attached the fixture adapter collar to the housing assembly.

20. The system of claim 1, wherein the connector further comprises a phase selector switch.

21. The system of claim 1, wherein the housing assembly further comprises a ground element.

22. The system of claim 1, wherein the first and second phase contacts are configured as male leads.

23. A multi-phase interconnection system for a multi-phase electrical system, comprising:

a modular cable assembly comprising a first modular connector, comprising:

a first housing assembly comprising a port configured for receiving armored cable;

a first connector insert disposed in the housing assembly;

a first phase contact in the first connector insert, the first phase contact comprising a contact end; and a second phase contact in the first connector insert, the phase contact comprising a contact end spaced from the contact end of the first phase contact in a direction of attachment, the first phase contact being connected to a source of a first phase of power, and the second phase contact being connected to a source of a second phase of power; and a second modular connector, comprising:

a second housing assembly comprising a port configured for receiving armored cable;

a second connector insert disposed in the second housing assembly, the second connector insert configured to be attached to the first connector insert the direction of attachment; and contacts in the second connector insert configured to sequentially contact the first and second phase contacts as the first and second modular connectors are connected along the direction of attachment.

24. The system of claim 23, wherein the contacts in the second connector insert comprise:

a third contact comprising a contact end; and a plurality of contacts comprising contact ends spaced from the contact end of the third contact in the direction of attachment.

25. The system of claim 24, wherein the contact ends of the plurality of contacts are equally spaced from the contact end of the third contact in the direction of attachment.

26. The system of claim 23, wherein the first housing assembly further comprises a first ground element, the first connector insert comprises an opening that receives the first ground element and positions the first ground element to ground the first modular connector;

the second housing assembly further comprises a second ground element; and the second connector insert comprises an opening that receives the second ground element and positions the second ground element to ground the second modular connector.

27. The system of claim 23, wherein the first housing assembly further comprises a first set of attachment openings, and a first cover comprising integral attachment elements inserted through the first set of attachment openings; and the second housing assembly further comprises a second set of attachment openings, and a second cover comprising integral attachment elements inserted through the second set of attachment openings.

28. The system of claim 23, wherein the first housing assembly further comprises a first protective element; and the second housing assembly further comprises a second protective element matable with the first protective element.

29. The system of claim 23, wherein the first connector insert comprises a first interlock element; and the second connector insert comprises a second interlock element that interlocks with the first interlock element when the second connector insert is attached to the first connector insert to reduce rocking between the first and second connector inserts.

30. The system of claim 1, wherein the multi-phase electrical system is a three-phase electrical system.

31. The system of claim 23, wherein the multi-phase electrical system is a three-phase electrical system.

* * * * *